US011120784B2

(12) United States Patent
Liang et al.

(10) Patent No.: US 11,120,784 B2
(45) Date of Patent: Sep. 14, 2021

(54) ULTRA-THIN SCHROEDER DIFFUSER

(71) Applicant: NANJING UNIVERSITY, Nanjing (CN)

(72) Inventors: Bin Liang, Nanjing (CN); Yifan Zhu, Nanjing (CN); Xinye Zou, Nanjing (CN); Jing Yang, Nanjing (CN); Xudong Fan, Nanjing (CN); Jianchun Cheng, Nanjing (CN)

(73) Assignee: NANJING UNIVERSITY, Nanjing (CN)

( * ) Notice: Subject to any disclaimer, the term of this patent is extended or adjusted under 35 U.S.C. 154(b) by 475 days.

(21) Appl. No.: 16/091,935

(22) PCT Filed: Jun. 15, 2017

(86) PCT No.: PCT/CN2017/088403
§ 371 (c)(1),
(2) Date: Oct. 5, 2018

(87) PCT Pub. No.: WO2017/177985
PCT Pub. Date: Oct. 19, 2017

(65) Prior Publication Data

US 2019/0130892 A1 May 2, 2019

(30) Foreign Application Priority Data

Apr. 15, 2016 (CN) ..... 201610236484.9

(51) Int. Cl.
*G10K 11/18* (2006.01)
*G10K 11/20* (2006.01)

(52) U.S. Cl.
CPC ..... *G10K 11/20* (2013.01)

(58) Field of Classification Search
CPC ..... G10K 11/20; G10K 11/02; G10K 11/04; G10K 11/16; G10K 11/172; G10K 11/18; E04B 1/99; E04B 1/84; E04B 1/82; E04B 2001/8476; E04B 2001/848; E04B 2001/8485
See application file for complete search history.

(56) References Cited

U.S. PATENT DOCUMENTS 2,703,627 A * 3/1955 Eustachio ..... E04B 1/86 181/286
3,180,448 A * 4/1965 Jolms ..... E04B 1/86 181/290
4,173,267 A * 11/1979 Chatani ..... H04R 1/20 181/148

(Continued)

*Primary Examiner* — Edgardo San Martin
(74) *Attorney, Agent, or Firm* — CBM Patent Consulting, LLC

(57) ABSTRACT

An ultra-thin Schroeder diffuser comprises a backing-plate, wherein the backing-plate is provided with 7×p rows and 7×q columns of unit cells, p and q are integers greater than or equal to 1, a side length of the unit cell is 0.48λ, a depth of the square unit cell is 0.04λ, the unit cell is provided with a square neck, a side length of the square neck is less than the side length of the unit cell, a depth of the neck is 0.01λ, λ is a wavelength of the diffuser corresponding to the design at a center frequency center $f_0$, the neck widths w of different unit cells are different, and a distribution of the widths satisfies a certain sequence.

4 Claims, 5 Drawing Sheets

(56) References Cited

U.S. PATENT DOCUMENTS

| | | | | |
|---|---|---|---|---|
| 4,821,839 | A * | 4/1989 | D'Antonio | E04B 1/86 181/198 |
| 5,457,291 | A * | 10/1995 | Richardson | B28B 23/0068 181/293 |
| 6,290,022 | B1 * | 9/2001 | Wolf | G10K 11/172 181/286 |
| 7,913,813 | B1 * | 3/2011 | Mathur | G10K 11/172 181/290 |
| 8,006,802 | B2 * | 8/2011 | Honji | E04B 1/86 181/293 |
| 8,579,079 | B2 * | 11/2013 | Beauvilain | B60R 13/08 181/290 |
| 8,789,651 | B2 * | 7/2014 | Kawai | G10K 11/168 181/290 |
| 10,699,688 | B2 * | 6/2020 | Elford | G10K 11/172 |
| 2009/0038883 | A1 * | 2/2009 | Kim | E04B 1/86 181/291 |
| 2011/0278091 | A1 * | 11/2011 | Honji | G10K 11/172 181/290 |
| 2015/0090526 | A1 * | 4/2015 | Sasaki | G10K 11/16 181/294 |
| 2016/0071507 | A1 * | 3/2016 | Kim | E01F 8/0005 181/286 |
| 2019/0333491 | A1 * | 10/2019 | Lee | G10K 11/162 |
| 2021/0012762 | A1 * | 1/2021 | Ohtsu | G10K 11/172 |
| 2021/0074255 | A1 * | 3/2021 | Guo | E04B 1/84 |

* cited by examiner

Prior Art

A

B

C

ULTRA-THIN SCHROEDER DIFFUSER

TECHNICAL FIELD

The invention relates to an ultra-thin Schroeder diffuser, and belongs to the field of acoustics.

BACKGROUND

A conventional Schroeder acoustic structure is provided with multiple unit cells, and an opening width and a bottom width of the unit cell are uniform, resulting in a thicker thickness of the Schroeder acoustic structure, generally λ/2, as shown in FIGS. 1 and 2, which is not conducive to the integration of acoustic devices.

SUMMARY

Object of the present invention: in order to overcome the deficiencies in the prior art, the present invention provides an ultra-thin Schroeder diffuser having a thickness of 1/10 of a conventional Schroeder diffuser and a smaller volume.

Technical solutions: in order to achieve the above-mentioned object, the present invention discloses an ultra-thin Schroeder diffuser, which comprises a backing-plate, wherein the backing-plate is provided with 7×p rows and 7×q columns of unit cells, p and q are integers greater than or equal to 1, a side length of the square unit cell is 0.48λ, a depth of the square unit cell is 0.04λ, the unit cell is provided with a square neck, a side length of the square neck is less than the side length of the unit cell, a depth of the neck is 0.01λ, λ is a wavelength of the diffuser corresponding to the design at a center frequency $f_0$, the neck widths w of different unit cells are different, and a distribution of the widths satisfies a certain sequence, so that expected phase distribution is achieved in the center frequency or multiple frequencies around the center frequency. A final diffuse reflection effect can be achieved within a certain bandwidth around the center frequency $f_0$.

Preferably, the p is 2, and the q is 2.

Preferably, the backing-plate has an acoustic impedance of at least 100 times an acoustic impedance of air. A certain center frequency $f_0$ needs to be selected when setting the diffuser. Center positions of two adjacent unit cells are spaced by λ/2. The diffuser can be designed as single frequency and multi-frequency Schroder diffusers. A unit phase response of the single frequency diffuser is designed for the center frequency $f_0$. The multi-frequency Schroeder diffuser is designed with mixedly arranged unit cells for multiple frequencies around the center frequency $f_0$ to achieve more broadband diffuse reflection.

Preferably, a target frequency of four is selected for the multi-frequency Schroeder diffuser.

Beneficial effects: the invention can implement broadband sound wave diffuse reflection, has a comparable performance of diffuse reflection to the conventional Schroeder diffusers, and can reduce a material thickness in the meanwhile; the thickness of the invention is λ/20 only in comparison to a conventional Schroeder thickness λ/2, which is convenient to use in practice.

DETAILED DESCRIPTION

The present invention is further explained with reference to the drawings hereinafter.

Figure 1:
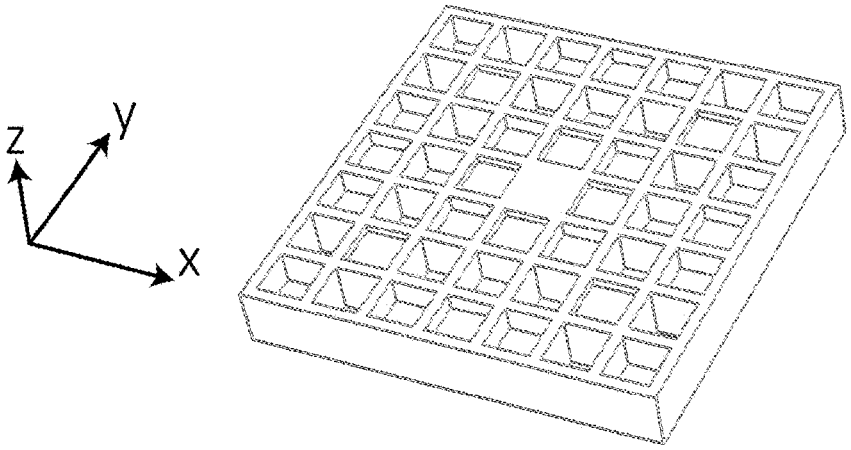
Fig. 1 Prior Art
FIG. 1 shows a structural schematic diagram of a conventional Schroeder diffuser.
Figure 2:
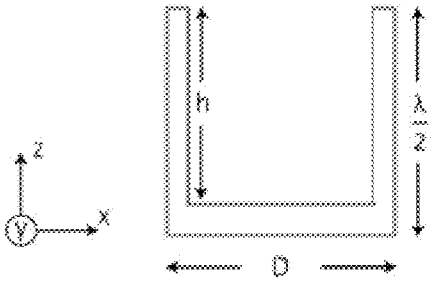
FIG. 2 shows a structural schematic diagram of unit cells in FIG. 1.
Figure 3:
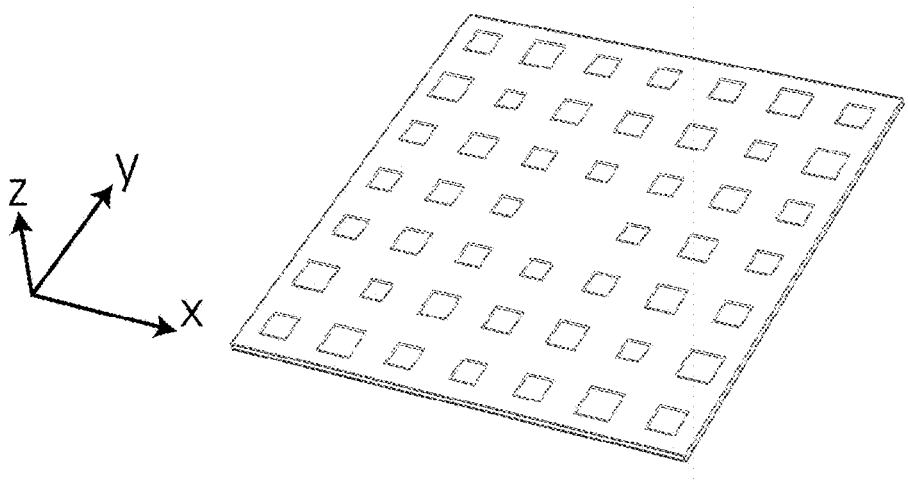
FIG. 3 shows a structural schematic diagram of a single period of the present invention.
Figure 4:
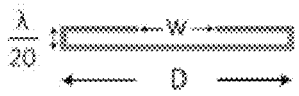
FIG. 4 shows a structural schematic diagram of unit cells in FIG. 3.

As shown in FIG. 3 and FIG. 4, an ultra-thin Schroeder unit is an ultra-thin acoustic unit cell, a thinness of which is λ/20 only, and a width thereof is the same as that of a conventional Schroeder unit cell. The unit cell structure is as shown in FIG. 4. A neck and a bottom of the unit cell have different widths, the neck width is w, and the bottom width of the unit cell is 0.48λ, and a resonance effect of the acoustic unit cell produces the same acoustic attributes as that of the conventional unit cell structure, thus achieving the effects similar to the conventional Schroeder diffuser. Therefore, the phase response of the unit cell on the surface designed by us shall satisfy:

$$\phi_{n,m} = \frac{2\pi[(n^2 + m^2)\text{modulo } N]}{N}$$

where n and m represent units cells in an $n^{th}$ row and an $m^{th}$ column, and modulo indicates remainder.

Figure 5:
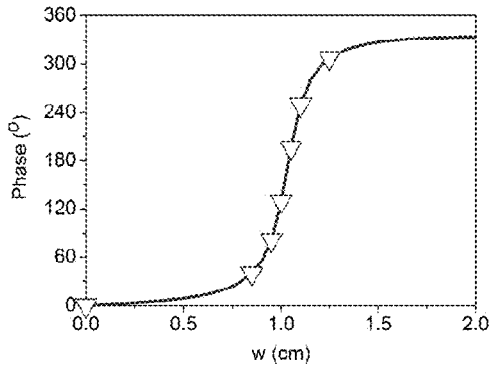
FIG. 5 shows a design flow of the present invention and a photograph of a sample when p=2, q=2.
Figure 5:
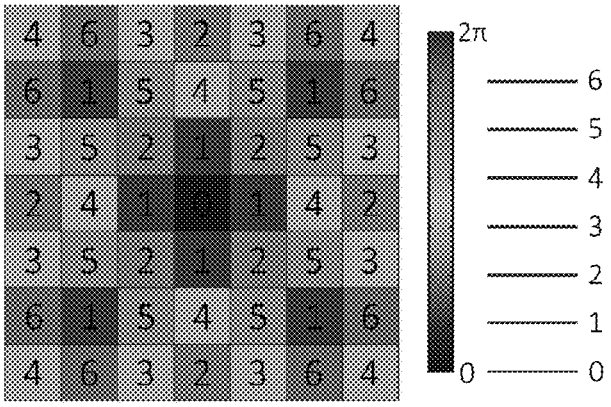
Figure 5:
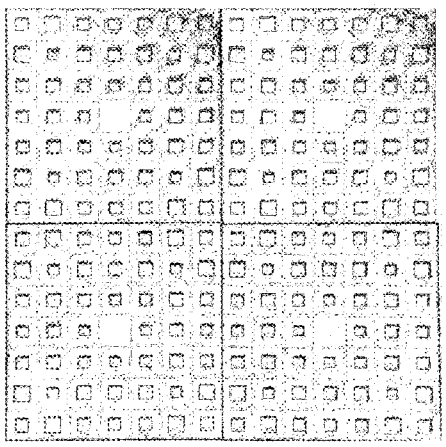

FIG. 5 shows a design of an ultra-thin Schroeder diffuser. FIG. 5A shows an analytical and simulated relationship between the phase shift and the geometrical parameter w. We control the phase shift of the unit cell by changing w. Triangles in FIG. 5A show phases 2π×(0–6/7). These seven discrete phases provide seven values needed in a Schroeder sequence. FIG. 5B shows]7×7 unit cells, numbers 0 to 6 represent the phase response of seven cells corresponding to 2π×(0–6/7), which are corresponding to seven points in FIG. 5A, and a final ultra-thin Schroeder diffuser sample can be designed through the sequence. FIG. 5C shows a top view of a sample that repeat 7×7 unit cells by a 2×2 (p=2, q=2) period, i.e., 14×14 unit cells. Structural parameters: as an example, the sample is designed to have a working center frequency of $f_0$=6860 Hz, and a sample size of 35 cm×35 cm×2.5 cm. A value range of w is as shown in FIG. 5A. In practical application, the sample size can be proportionally adjusted according to a working wavelength.

To quantitatively characterize a diffuse scattering effect, diffuse reflection coefficients can be defined as:

$$d_\psi = \frac{\left(\sum_{i=1}^{n} 10^{L_i/10}\right)^2 - \sum_{i=1}^{n} (10^{L_i/10})^2}{(n-1)\sum_{i=1}^{n} (10^{L_i/10})^2}$$

where $L_i$ are a set of sound pressure levels (SPLs) in the polar response, n is the number of receivers in the experiment, and the subscript ψ is the angle of incidence. The normalized diffuse reflection coefficients can be expressed as:

$$d_{\psi,n} = \frac{d_\psi - d_{\psi,r}}{1 - d_{\psi,r}}$$

where $d_\psi$ and $d_{\psi,r}$ are the calculated diffuse reflection coefficients of the sample and the reference flat surface respectively.

Figure 6:
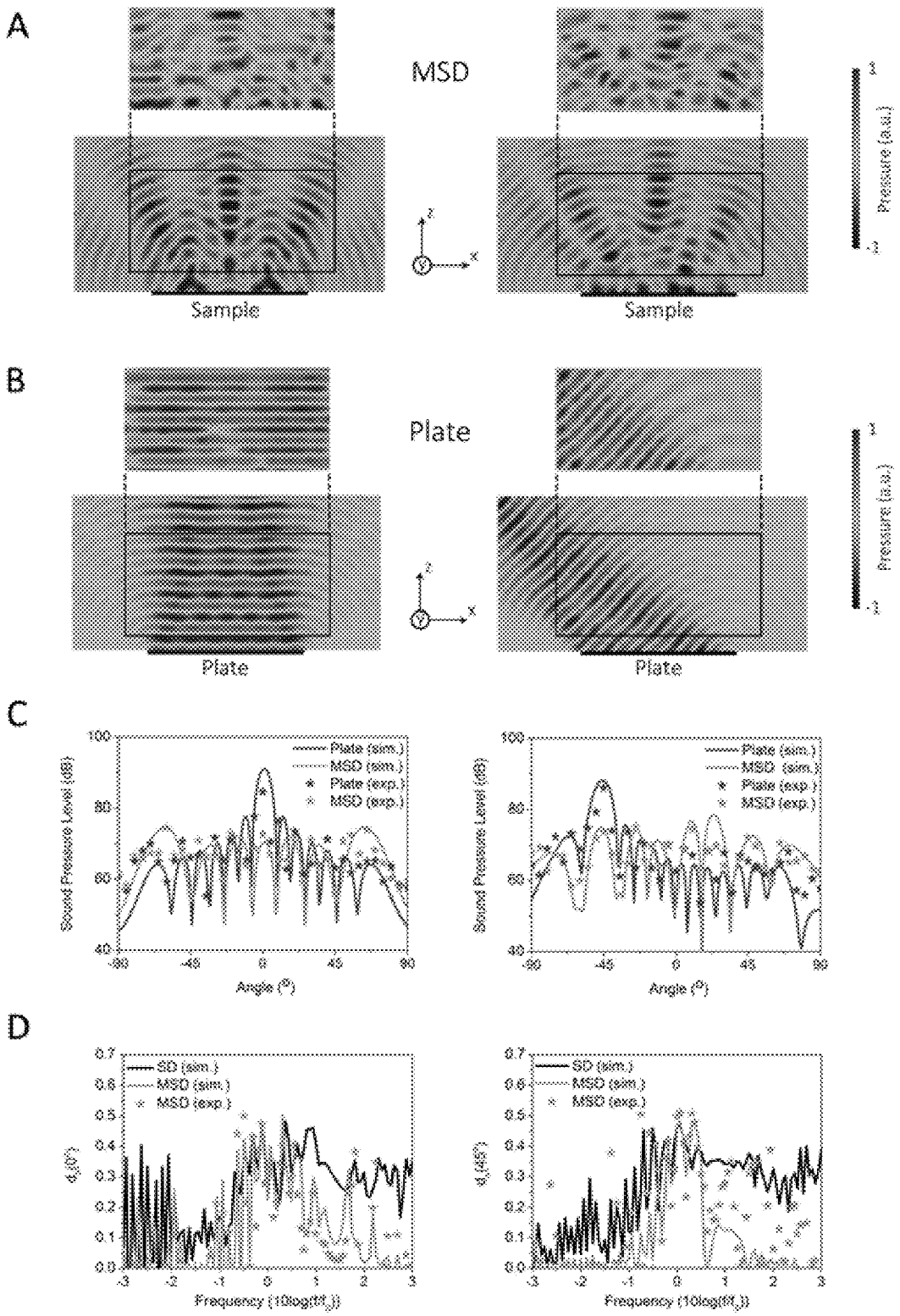
FIG. 6 shows numerical simulation and experimental results of the ultra-thin Schroeder diffuser (MSD).

FIG. 6 shows numerical simulation and experimental results of an ultra-thin Schroeder diffuser. FIG. 6A shows reflection fields of the ultra-thin Schroeder diffuser (MSD) at normal incidence and 45-degree oblique incidence. Comparing the experimental (exp.) and simulation (sim.) results of the backing-plate in FIG. 6B, the diffuse reflection effect of the ultra-thin Schroeder diffuser can be clearly seen. FIG. 6C shows that the samples at normal incidence and 45-degree incidence are consistent with the backing-plate directivity and acoustic pressure field results. FIG. 6D shows normalized diffuse reflection coefficients $d_{0,n}$ and $d_{45,n}$ of a conventional Schroeder diffuser (SD) and the ultra-thin Schroeder diffuser (MSD). It can be seen that the ultra-thin Schroeder diffuser can better simulate the diffuse reflection effect of the conventional Schroeder diffuser within about one octave around the center frequency $f_0$.

Figure 7:
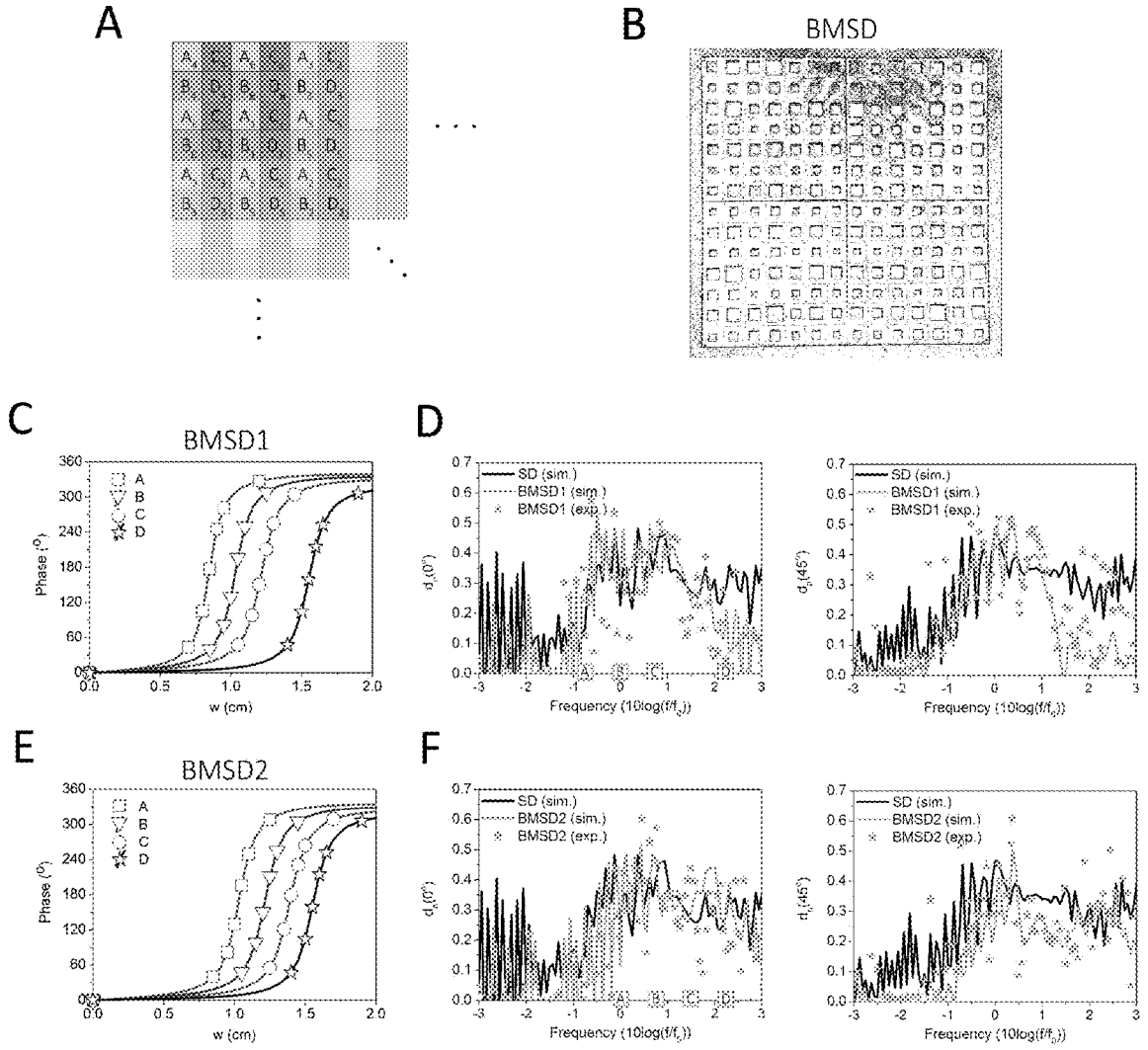
FIG. 7 shows a design flow and numerical simulation and experimental results of a multi-frequency ultra-thin Schroeder diffuser (BMSD).

In order to obtain a wider bandwidth, it is possible to design a unit cell for multiple frequencies to form a diffuser of mixedly arranged unit cells corresponding to different frequencies, as shown in FIG. 7, showing a design method for multi-frequency ultra-thin Schroeder diffuser (BMSD). FIG. 7A shows a 14×14 composite sequence formed by four-frequency 7×7 sequences, according to which four mixedly arranged unit cells are designed. The four unit cells correspond to four different frequencies. In the figure, A, B, C, and D respectively represent unit cells designed on the basis of the four frequencies, subscript numbers 0 to 6 represent seven phases, and FIG. 7B shows a sample photo of 14×14 unit cells. FIGS. 7C and 7D, and FIGS. 7E and 7F show two multi-frequency ultra-thin Schroeder diffusers BMSD1 and BMSD2 designs. Coordinate axes of FIG. 7D and FIG. 7F mark that positions of the four designed frequencies relative to the center frequency are respectively as follows: 5772 Hz, 6860 Hz, 8153 Hz and 11517 Hz for BMSD1, and 6860 Hz, 8153 Hz, 9690 Hz and 11517 Hz for BMSD2. FIGS. 7C and 7E show the unit cell parameters of four frequencies. The figures show the unit cells corresponding to different frequencies. Different ws need to be set to achieve expected phase distribution. FIGS. 7D and 5F show diffuse reflection factors $d_{0,n}$ and $d_{45,n}$ at normal incidence and 45-degree incidence. Comparing the conventional Schroder diffuser (SD) with the ultra-thin Schroder diffuser (MSD) and multi-frequency ultra-thin Schroder diffuser (BMSD) results, it can be seen that the multi-frequency ultra-thin Schroeder diffuser can obtain a wider bandwidth and higher efficiency than that of the ultra-thin Schroeder diffuser.

The descriptions above are merely preferable embodiments of the invention, and it should be noted that those of ordinary skills in the art may make a plurality of improvements and decorations without departing from the principle of the invention, and these improvements and decorations shall also fall within the protection scope of the invention.

What is claimed is:

1. An ultra-thin Schroeder diffuser, comprising a backing-plate, wherein the backing-plate is provided with 7×p rows and 7×q columns of unit cells, p and q are integers greater than or equal to 1, a side length of a square unit cell is 0.48λ, a depth of the square unit cell is 0.04λ, each of the unit cells is provided with a square neck, a side length of the square neck is less than a side length of the each of the unit cell, a depth of the square neck is 0.01λ, λ is a wavelength of a diffuser corresponding to a design at a center frequency $f_0$, and neck widths w of the unit cells are variable;

wherein a phase response of surfaces of the unit cells satisfies following formula:

$$\phi_{n,m} = \frac{2\pi[(n^2 + m^2)\text{modulo}N]}{N}$$

wherein, $\phi_{n,m}$ represents the phase response, n and m represents an $n^{th}$ row and an $m^{th}$ column, respectively, for each of the unit cells, N represents numbers of the unit cells and modulo indicates remainder.

2. The ultra-thin Schroeder diffuser according to claim 1, wherein the p is 2, and the q is 2.

3. The ultra-thin Schroeder diffuser according to claim 1, wherein the backing-plate has an acoustic impedance of at least 100 times an acoustic impedance of air.

4. The ultra-thin Schroeder diffuser according to claim 1, wherein center positions of two adjacent unit cells are spaced by λ/2.

* * * * *